US006628254B1

(12) United States Patent
Matsumura

(10) Patent No.: US 6,628,254 B1
(45) Date of Patent: Sep. 30, 2003

(54) DISPLAY DEVICE AND INTERFACE CIRCUIT FOR THE DISPLAY DEVICE

(75) Inventor: Tatsuya Matsumura, Kikuchi (JP)

(73) Assignee: Advanced Display Inc., Kikuchi-gun (JP)

( * ) Notice: Subject to any disclaimer, the term of this patent is extended or adjusted under 35 U.S.C. 154(b) by 0 days.

(21) Appl. No.: 09/525,314

(22) Filed: Mar. 13, 2000

(30) Foreign Application Priority Data

Mar. 31, 1999 (JP) ..... 11-093952

(51) Int. Cl.[7] ..... G09G 5/34

(52) U.S. Cl. ..... 345/87; 345/90; 345/98; 345/99; 345/100; 345/103; 345/204; 345/205; 348/542; 348/543; 348/544; 348/545; 348/554; 348/555

(58) Field of Search ..... 345/87, 90, 98, 345/99, 100, 103, 204, 205; 348/441, 542–545, 554, 555

(56) References Cited

U.S. PATENT DOCUMENTS 4,780,764 A * 10/1988 Kinoshita et al.
4,978,952 A * 12/1990 Irwin ..... 345/102
5,812,210 A * 9/1998 Arai et al.
6,252,572 B1 * 6/2001 Kurumisawa et al. ..... 345/100
6,295,048 B1 * 9/2001 Ward et al.
6,310,602 B1 * 10/2001 Kasai et al.
6,331,862 B1 * 12/2001 Yamada et al.
6,335,760 B1 * 1/2002 Sato ..... 348/397.1

* cited by examiner

*Primary Examiner*—Bipin Shalwala
*Assistant Examiner*—Vincent E. Kourlick
(74) *Attorney, Agent, or Firm*—Oblon, Spivak, McClelland, Maier & Neustadt, P.C.

(57) ABSTRACT

The present invention is directed to a display device such as a liquid crystal display including: a horizontal clock counter and a vertical clock counter which count each clock signal every horizontal cycle and every vertical cycle for a valid data period of a data enable input signal; and an input signal generating section for holding a count value and generating an input signal in a driver IC and a driving circuit corresponding to a resolution of the display device which is obtained at that time by utilizing a count value held at a last time for a next horizontal cycle or a next vertical cycle, the display device being applicable to the driver IC and the driving circuit which can be used for the display device having various resolutions.

5 Claims, 8 Drawing Sheets

DISPLAY DEVICE AND INTERFACE CIRCUIT FOR THE DISPLAY DEVICE

BACKGROUND OF THE INVENTION

The present invention relates to a display device such as a liquid crystal display and an interface circuit for the display device.

FIG. 6 is a diagram showing the structure of a display device such as a liquid crystal display. In FIG. 6, reference numeral 1 denotes a display screen such as a liquid crystal panel, reference numeral 2 denotes a driving circuit 1 such as a scanning line driving circuit, reference numeral 3 denotes a driving circuit 2 such as a signal line driving circuit, reference numeral 4 denotes a control circuit for generating input signals of the scanning line driving circuit 2 and the signal line driving circuit 3, and reference numeral 5 denotes a power source section for generating reference voltages of a circuit system.

In the structure of the electric circuit of the display device, a signal input from the outside (an input signal in the control circuit 4) includes a clock input signal, a video data input signal, a data enable input signal and other input signals for control (a horizontal synchronizing input signal, a vertical synchronizing input signal and the like). The data enable input signal indicates a valid data period in the video data input signal for a time base, and usually represents a voltage level of H for the valid data period and a voltage level of L for a period other than the valid data period.

FIG. 7 is a voltage waveform diagram showing a signal input to the control circuit 4 every horizontal cycle. In FIG. 7, an axis of abscissa denotes an elapsed time, reference numeral 6 denotes a horizontal synchronizing input signal, reference numeral 7 denotes a data enable input signal, reference numeral 8 denotes a clock input signal, reference numeral 9 denotes a video data input signal, reference numeral 10 denotes a valid data period in the video data input signal, 1CLK denotes a cycle of the clock input signal 8, 1H denotes a cycle of the horizontal synchronizing input signal, an arrow of the clock input signal represents an active edge (a falling edge in the drawing) of the clock input signal 8, the blank portion of the video data input signal 9 represents a valid data period, the oblique line portion of the video data input signal represents an invalid data period, and m represents a screen size (resolution) in a horizontal direction. A voltage level of L in the horizontal synchronizing input signal 6 indicates a reset period, that is, a period in which there is no valid data.

FIG. 8 is a voltage waveform diagram showing a signal to be input to the control circuit 4 every vertical cycle. In FIG. 8, an axis of abscissa denotes an elapsed time, the reference numeral 11 denotes a vertical synchronizing input signal, 1H denotes a cycle of a horizontal synchronizing input signal, 1V denotes a cycle of the vertical synchronizing input signal, the blank portion of a video data input signal represents a valid data period, the oblique line portion of the video data input signal represents an invalid data period, and n denotes a screen size (resolution) in a vertical direction. A voltage level of L in the vertical synchronizing input signal 11 indicates a reset period, that is, a period in which there is no valid data.

As the output signal of the control circuit 4, moreover, a clock signal and a data signal other than the clock signal are generated to be used for the input signal of a driver IC and a driving circuit which generates a signal for driving the control circuit 4, that is, the scanning line driving circuit 2 and the signal line driving circuit 3. The clock signal implies a clock signal to be used in the scanning line driving circuit 2 and the signal line driving circuit 3 (a vertical clock output signal in the scanning line driving circuit 2 and a horizontal clock output signal in the signal line driving circuit 3), respectively. The data signal other than the clock signal implies a video data signal (a horizontal video data output signal) and a control signal other than the video data signal (a horizontal start output signal, a vertical start output signal, a horizontal latch output signal, a horizontal driving voltage polarity control output signal and the like).

However, the kind of the display device is increased with the diversification of the screen size and the resolution in the display device. Consequently, a control circuit 4 for generating a signal to be input to the driver IC and the driving circuit which generate a signal for driving a display screen or a part of the control circuit should be separately developed and fabricated to have a circuit for generating a signal having a timing relationship matched to each kind of the display device. For this reason, a period for the development and a cost of the development become important problems.

In other words, a conventional control circuit or a part of the control circuit can be operated with values of m and n which are uniquely determined for each kind of the display device in FIGS. 2 and 3. Therefore, there is a problem in that the control circuit or a part of the control circuit cannot be used when m and n are not equal to set values or are changed during the display operation.

It is an object of the present invention to provide a display device such as a liquid crystal display and an interface circuit for the display device which can solve the above-mentioned problems and implement an interface circuit for a display device capable of optionally changing a display size (resolution) corresponding to a display screen mode, thereby shortening a period for development and reducing a cost of the development.

In case where the function of optionally changing the display size (resolution) in a display screen mode is to be provided in the prior art, software and hardware of a system for generating an input signal in the display device should be developed. Therefore, there is a problem in that the development and fabrication should be separately carried out for each system.

It is another object of the present invention to provide a display device such as a liquid crystal display and an interface circuit for the display device which can solve the above-mentioned problem, can shorten a period for development and reduce a cost of the development and has the function of easily changing an optional display size (resolution) in a display screen mode by adding a simple circuit.

SUMMARY OF THE INVENTION

The present invention provides a display device such as a liquid crystal display and an interface circuit for the display device which have the function of counting a valid data period of a data enable input signal every horizontal cycle and every vertical cycle, holding a count value and generating an input signal in a driver IC and a driving circuit corresponding to a resolution of the display device which is obtained at that time by utilizing a count value held last time for a next horizontal cycle or a next vertical cycle so as to be applicable to the driver IC and the driving circuit which can be used for the display unit having various resolutions, thereby solving the above-mentioned problems to shorten a period of development and to reduce a cost of the development.

The present invention provides a display device such as a liquid crystal display and an interface circuit for the display device which have, in the function of selecting a display screen mode for display with an optional display size (resolution), the function of controlling a valid data period of a data enable input signal corresponding to a display screen mode selected at that time, counting the valid data period of the data enable input signal every horizontal cycle and every vertical cycle, holding a count value and generating an input signal in a driver IC and a driving circuit corresponding to a resolution of the display device which is obtained at that time by utilizing a count value held last time for a next horizontal cycle or a next vertical cycle, and the function of easily changing the optional display size (resolution) in a display screen mode so as to solve the above-mentioned problems and to shorten a period of development and reduce a cost of the development.

The present invention provides a display device such as a liquid crystal display and an interface circuit for the display device have, in the function of selecting a display screen mode for display with an optional display size (resolution), the function of controlling a valid data period of a data enable input signal corresponding to a display screen mode selected at that time and simultaneously recognizing a value of the resolution in response to a selecting input signal to generate an input signal in a driver IC and a driving circuit corresponding to a resolution of the display device and the function of easily changing the optional display size (resolution) in a display screen mode so as to solve the above-mentioned problems and to shorten a period of development and reduce a cost of the development.

The present invention provides a display device such as a liquid crystal display and an interface circuit for the display device have, in the function of selecting a display screen mode for display with an optional display size (resolution), the function of controlling a valid data period of a video data input signal corresponding to a display screen mode selected at that time and generating an input signal in a driver IC and a driving circuit corresponding to a resolution of the display device and the function of easily changing the optional display size (resolution) in a display screen mode so as to solve the above-mentioned problems and to shorten a period of development and reduce a cost of the development.

These objects as well as other objects, features and advantages of the invention will become more apparent to those skilled in the art from the following description with reference to the accompanying drawings.

DETAILED DESCRIPTION EMBODIMENT 1

Figure 1:
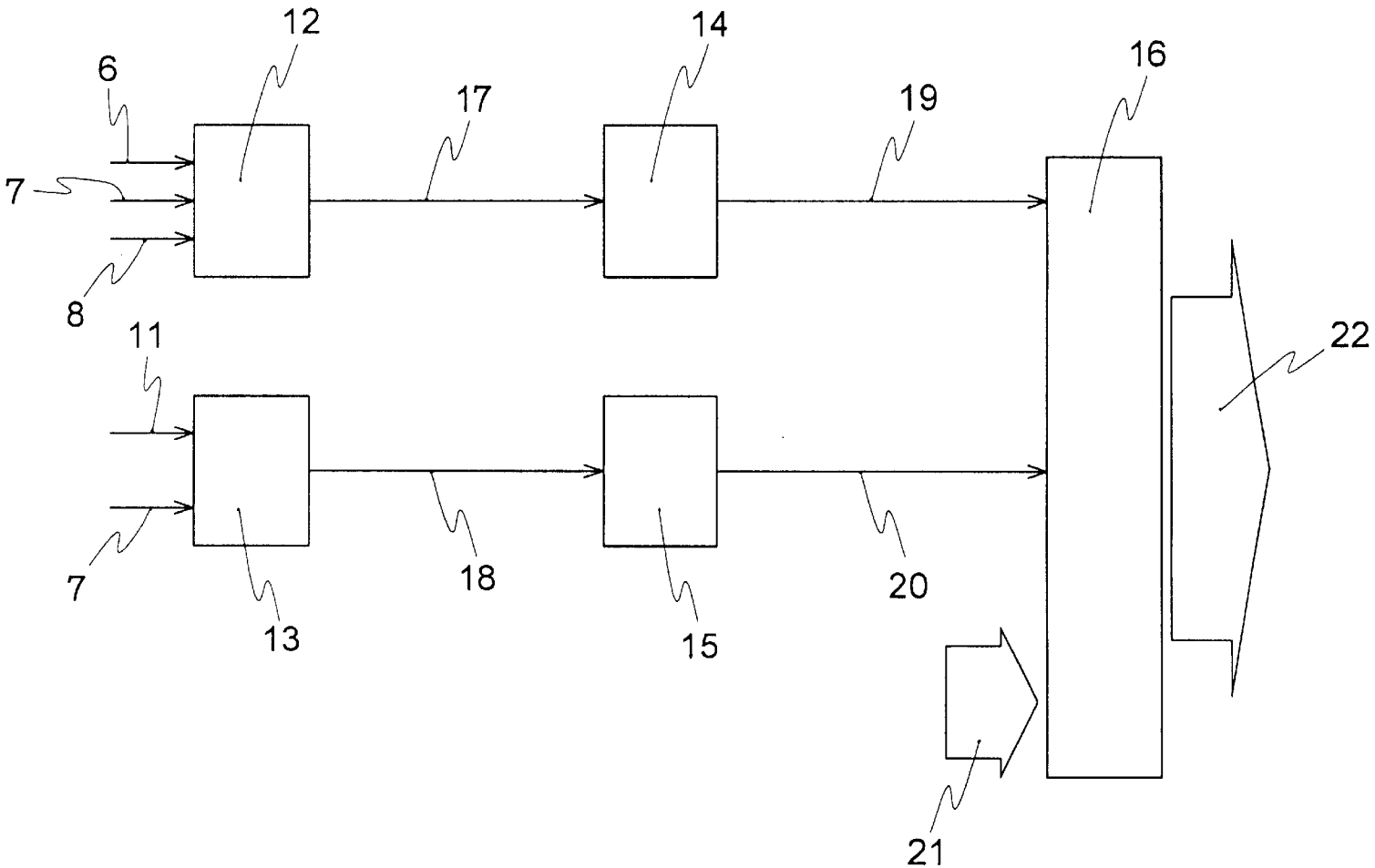
FIG. 1 is a functional block diagram for showing a structure of the circuit of a control circuit or a part of the control circuit in a display device of embodiment 1 of the present invention.

FIG. 1 is a diagram showing, for each functional block, the structure of a control circuit provided in a display device or a part of the control circuit (an interface circuit) according to an EMBODIMENT 1 of the present invention. In FIG. 1, reference numeral 12 denotes a horizontal clock counter for counting a clock number for a valid data period for each horizontal cycle, that is, a circuit section for counting a resolution in a horizontal direction, reference numeral 13 denotes a vertical clock counter for counting a data enable input signal 7 as a clock signal for a valid data period for each vertical cycle, that is, a circuit section for counting a resolution in a vertical direction, reference numeral 14 denotes a horizontal clock count memory for holding a value counted in a last stage for a predetermined period or all the time, reference numeral 15 denotes a vertical clock count memory for holding a value counted in a last stage for a predetermined period or all the time, reference numeral 16 denotes an input signal generating section a driver IC and a driving circuit, reference numeral 17 denotes a horizontal clock count signal indicative of a counted value, reference numeral 18 denotes a vertical clock count signal indicative of a counted value, reference numeral 19 denotes a signal indicative of a counter value holding the horizontal clock count signal 17 for a predetermined period or all the time, reference numeral 20 denotes a signal indicative of a counter value holding the vertical clock count signal 18 for a predetermined period or all the time, reference numeral 21 denotes a plurality of signals input from the outside, and reference numeral 22 denotes a plurality of signals output to the outside which are input to the driver IC and the driving circuit. In some cases, the input signal generating section 16 includes a conventional control circuit or a part of the conventional control circuit.

Figure 7:
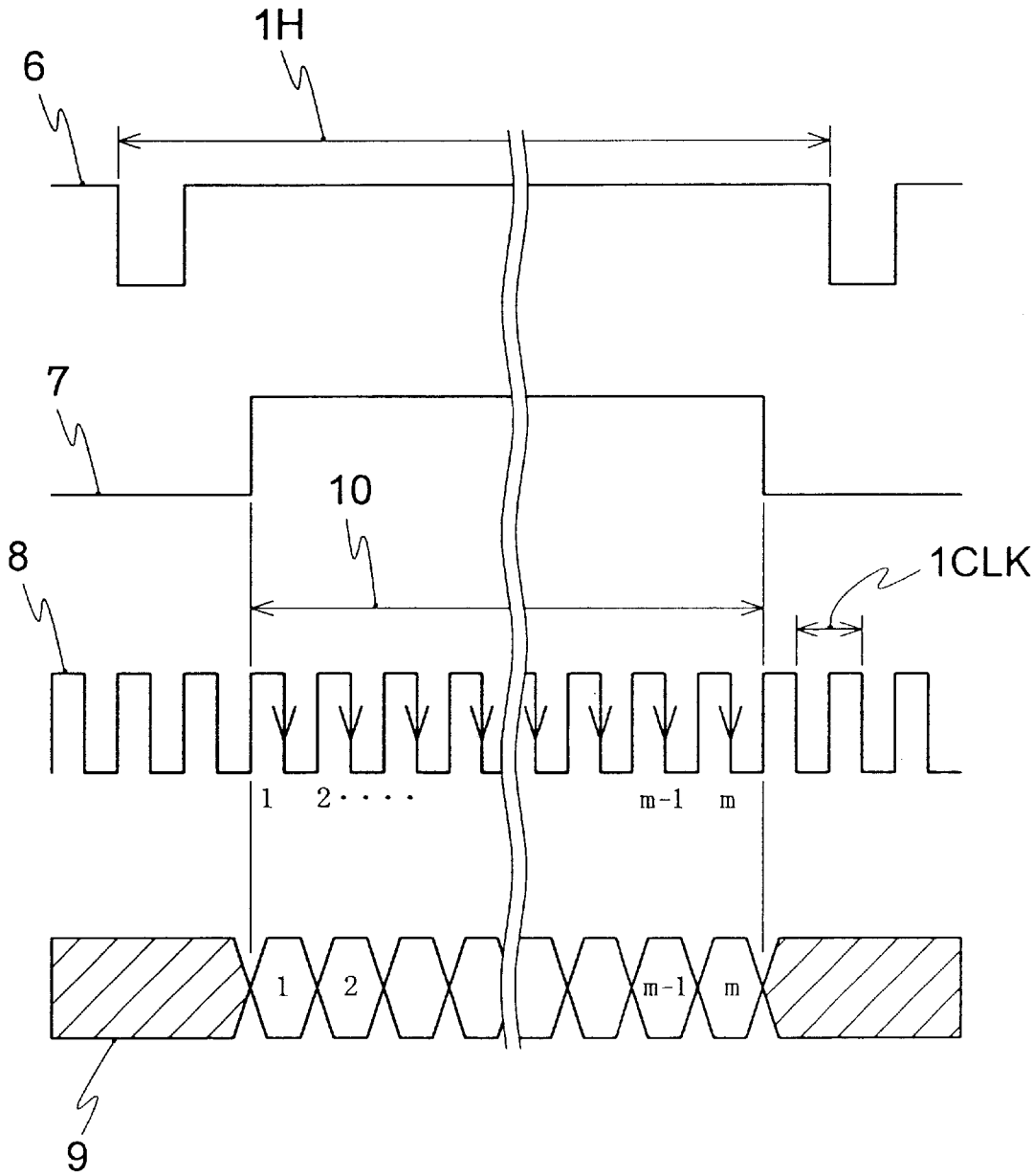
FIG. 7 is a wave form chart illustrating a relation of input part at each of the horizontal period in a control circuit of the conventionally used display device.

First of all, the horizontal synchronizing input signal 6, the data enable input signal 7 and the clock input signal 8 in FIG. 7 are input to the horizontal clock counter 12 in FIG. 1, thereby counting a valid data period for each horizontal cycle up to a value of m by a clock as a unit and outputting a result as the horizontal clock count signal 17. In response to the horizontal clock count signal 17, the horizontal clock count memory 14 holds the value of m for a predetermined period or all the time and outputs the value of m as the horizontal clock count signal 19.

Figure 8:
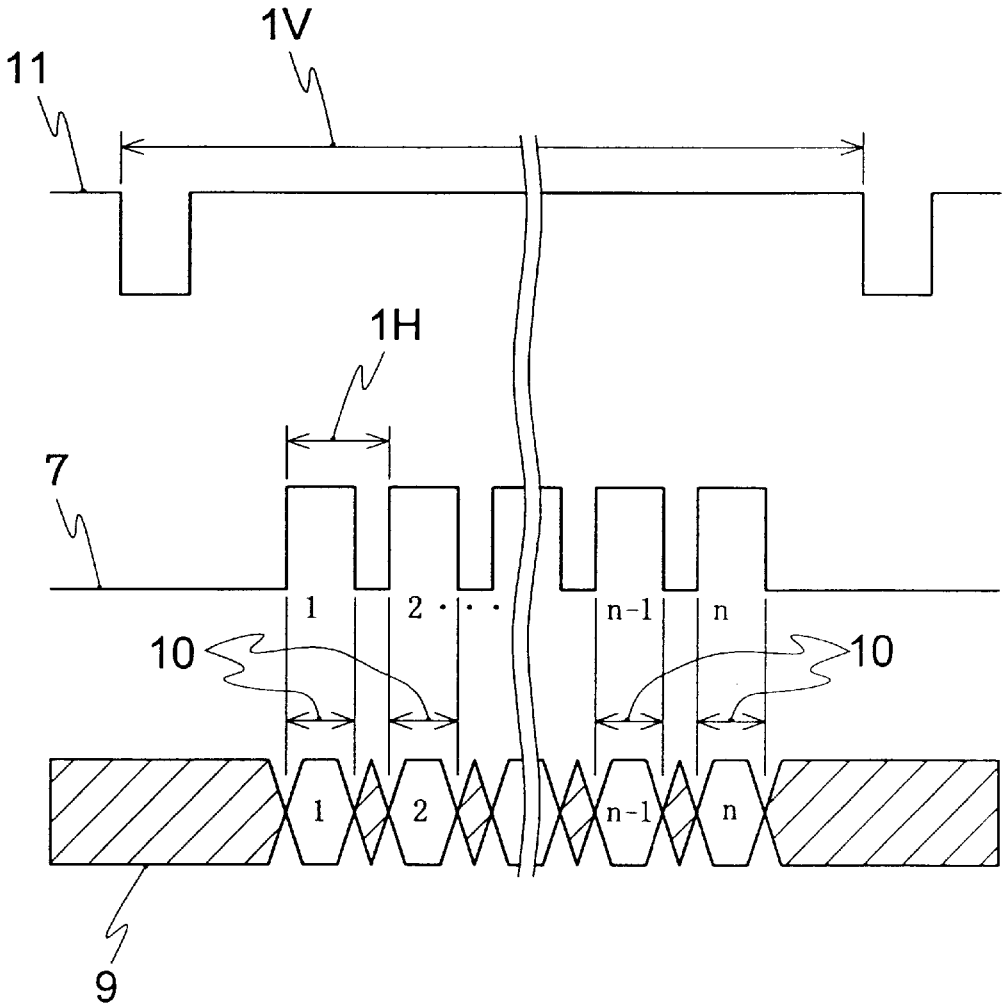
FIG. 8 is a wave form chart illustrating a relation of input part at each of the vertical period in a control circuit of the conventionally used display device.

Similarly, the data enable input signal 7 and the vertical synchronizing signal 11 in FIG. 8 are input to the vertical clock counter 13, thereby counting a valid data period for each vertical cycle up to a value of n in a clock unit and outputting a result as the vertical clock count signal 18. In response to the vertical clock count signal 18, the vertical clock count memory 15 holds the value of n for a predetermined period or all the time and outputs the value of n as the vertical clock count signal 20.

As described above, the horizontal clock count signal 19 and the vertical clock count signal 20 which are output from the horizontal clock count memory 14 and the vertical clock count memory 15 and a plurality of input signals 21 in the input signal generating section 16 are input to the signal generating section 16. Consequently, the input signal generating section 16 recognize the values output in the last stage (the values of m and n in FIGS. 7 and 8) to generate a signal to be input to the driver IC and the driving circuit corresponding to a resolution of a display device, and outputs the same signal as a signal 22 to be input to the driver IC and the driving circuit.

Consequently, when the data enable input signal is input corresponding to an optional resolution in FIG. 1, the values (m, n) of the resolution are automatically recognized to generate a signal to be input to the driver IC and the driving circuit corresponding to the resolution of the display device which is applied at that time. Thus, the present invention can be applied to the driver IC and the driving circuit which can be used in the display device having various resolutions.

According to the EMBODIMENT 1, the valid data period of the data enable input signal is counted with each clock every horizontal cycle and every vertical cycle, the counted value is held and the value held at the last time is utilized for the next horizontal cycle or the next vertical cycle, thereby generating a signal to be input to the driver IC and the driving circuit corresponding to the resolution of the display device which is applied at that time. Consequently, the present invention can be applied to the driver IC and the driving circuit which can be used in the display device having various resolutions. Thus, it is possible to obtain the effect that a period for development can be shortened and a cost of the development can be reduced.

According to the Embodiment 1, both horizontal clock counter 12 and vertical clock counter 13 and their associate count memories are provided, however, in case where wither horizontal or vertical counting is needed, provision of either horizontal or vertical counter will ve sufficient.

EMBODIMENT 2

Figure 2:
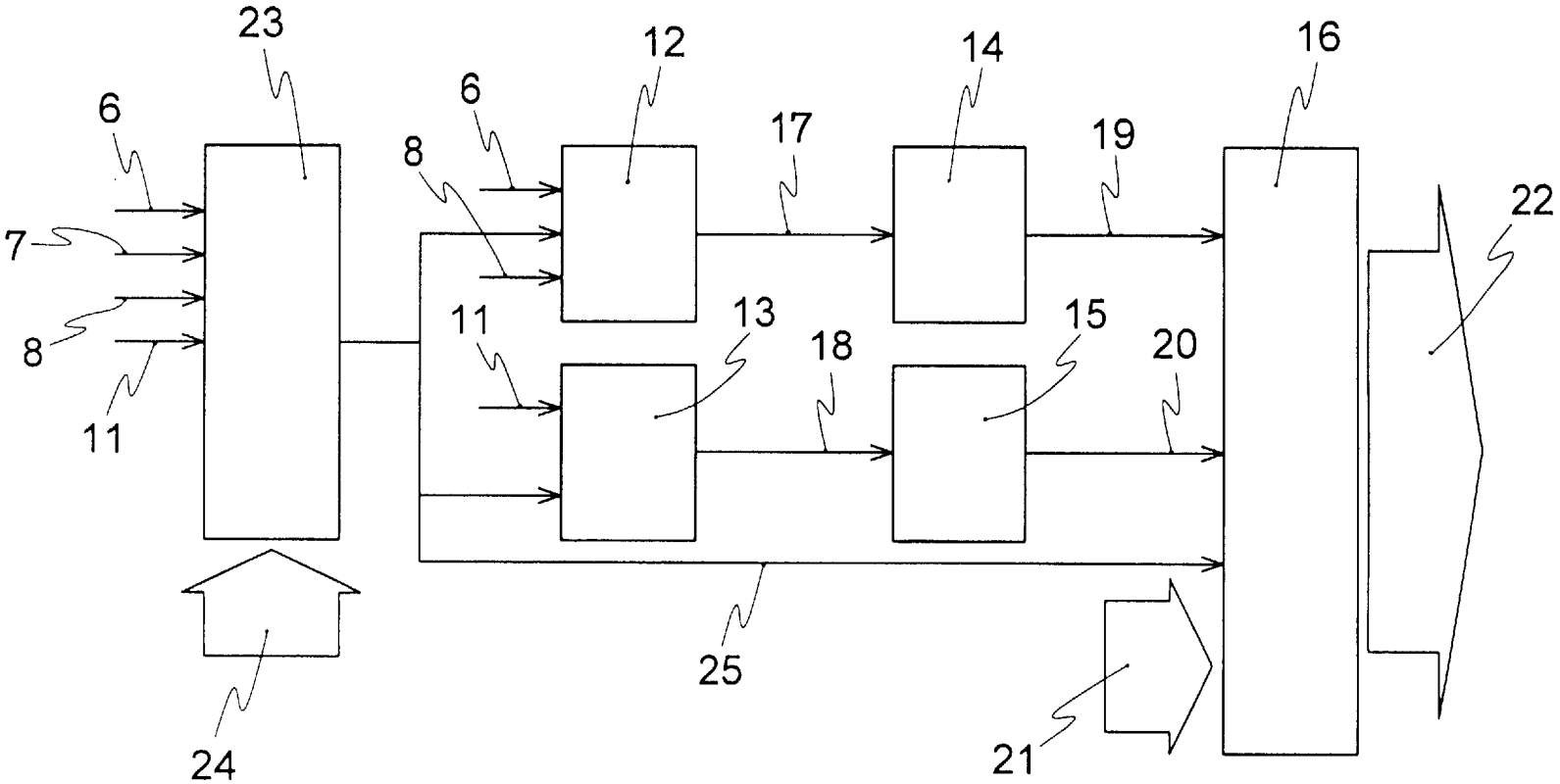
FIG. 2 is a functional block diagram 1 for showing a structure of the circuit of a control circuit or a part of the control circuit in a display device of embodiment 2 of the present invention.

FIG. 2 is a diagram showing, the structure of a control circuit or a part of the control circuit provided in a display device for each functional block according to an EMBODIMENT 2 of the present invention. In FIG. 2, reference numeral 12 denotes a horizontal clock counter for counting a clock number for a valid data period for each horizontal cycle, that is, a circuit section for counting a resolution in a horizontal direction, reference numeral 13 denotes a vertical clock counter for counting a clock number for a valid data period every vertical cycle, that is, a circuit section for counting a resolution in a vertical direction, reference numeral 14 denotes a horizontal clock count memory for holding a horizontal clock count value counted in a last stage for a predetermined period or all the time, reference numeral 15 denotes a vertical clock count memory for holding a vertical clock count value counted in a last stage for a predetermined period or all the time, reference numeral 16 denotes an input signal generating section for a driver IC and a driving circuit, reference numeral 23 denotes a section for selecting a valid data period in a data enable input signal, reference numeral 17 denotes a horizontal clock count signal, reference numeral 18 denotes a vertical clock count signal, reference numeral 19 denotes a signal indicative of a counter value holding the horizontal clock count signal 17 for a predetermined period or all the time, reference numeral 20 denotes a signal indicative of a counter value holding the vertical clock count signal 18 for a predetermined period or all the time, reference numeral 21 denotes a plurality of signals to be input from the outside, and reference numeral 22 denotes a plurality of signals to be output to the outside (signals to be input to the driver IC and the driving circuit), reference numeral 24 denotes a selecting input signal in a display screen mode for display with an optional display size (resolution), and reference numeral 25 denotes a data enable input signal indicative of a valid data period in the selected resolution. In some cases, the input signal generating section 16 includes a conventional control circuit or a part of the conventional control circuit.

In the valid data period selecting section 23, first of all, a display screen mode for display with an optional display size (resolution) is uniquely selected in response to the selecting input signal 24 sent from the outside, and the data enable input signal 25 indicative of the valid data period corresponding to the resolution is generated and output. The structure of the circuit connected following the valid data period selecting section 23 and others and the contents of an operation are the same as those in FIG. 1.

Consequently, when the display screen mode for display with an optional display size (resolution) is selected in response to the selecting input signal 24 in the display screen mode in FIG. 2, the data enable input signal 25 indicative of the valid data period corresponding to the display screen mode selected at that time is generated by the data valid period selecting section 23 and the valid data period of the data enable input signal is counted with each clock every horizontal cycle and every vertical cycle, and the value (count value) of the resolution is automatically recognized to generate the input signal 22 in the driver IC and the driving circuit corresponding to the resolution of the display device which is obtained at that time. Consequently, the present invention can be applied to the driver IC and the driving circuit which can be used in the display device having various resolutions, and the optional display size (resolution) in the display screen mode can be changed easily.

While the resolution (values of m and n) in the display screen mode can be counted and recognized from the input signal and the display can be carried out corresponding to the display screen mode having an optional resolution in the EMBODIMENT 1, the resolutions of the input signal and the display device should be coincident with each other as necessary conditions. In the EMBODIMENT 2, also in case where the resolutions of the display screen mode and the display device are not coincident with each other, they can become coincident with each other.

Figure 3:
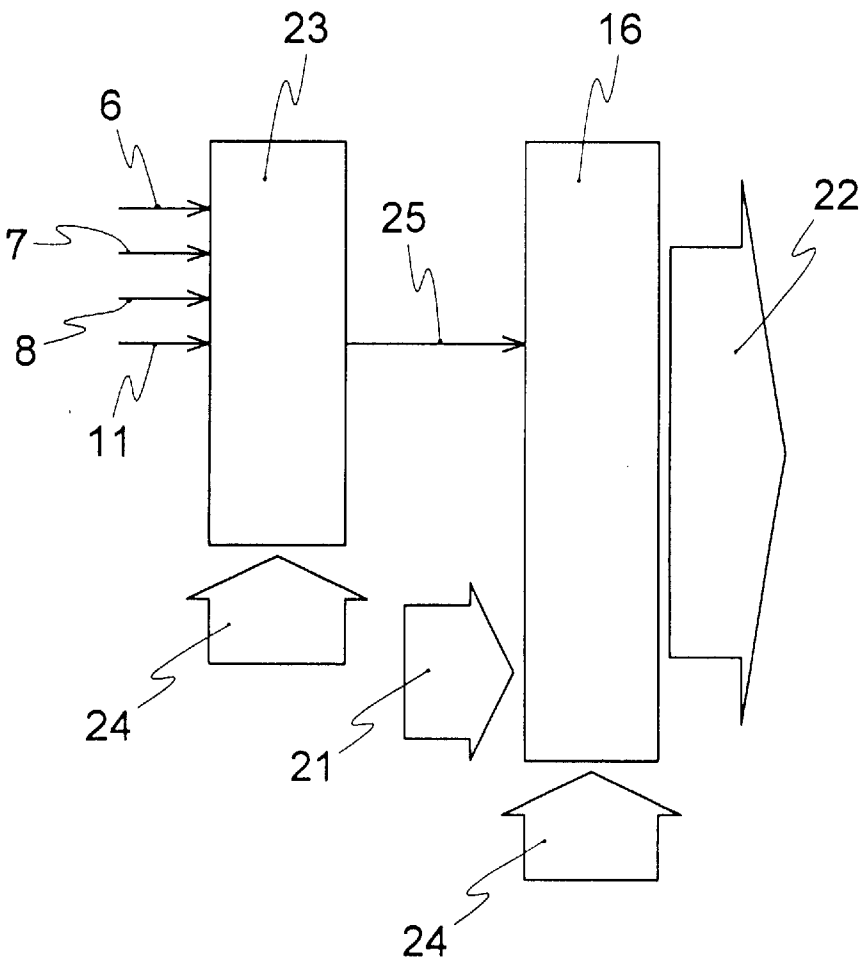
FIG. 3 is a functional block diagram 2 for showing a structure of the circuit of a control circuit or a part of the control circuit in a display device of embodiment 2 of the present invention.

FIG. 3 is a diagram showing, for each functional block, the structure of a control circuit provided in a display device or a part of the control circuit according to another example of the EMBODIMENT 2 of the present invention. In FIG. 3, reference numeral 16 denotes an input signal generating section in a driver IC and a driving circuit, reference numeral 23 denotes a section for selecting a valid data period in a data enable input signal, reference numeral 21 denotes a plurality of signals to be input from the outside, reference numeral 22 denotes a plurality of signals to be output to the outside, reference numeral 24 denotes a selecting input signal in a display screen mode for display with an optional display size (resolution), and reference numeral 25 denotes a data enable input signal indicative of a valid data period in the selected resolution. In some cases, the input signal generating section 16 includes a conventional control circuit or a part of the control circuit.

Thus, when the display screen mode for display with an optional display size (resolution) is selected in response to the selecting input signal 24 in the display screen mode in FIG. 3, the data enable input signal 25 indicative of the valid data period corresponding to the display screen mode selected at that time is generated and the input signal generating section 16 simultaneously recognizes, in response to the selecting input signal 24, the value of the resolution which is obtained at that time, thereby generating the input signal in the driver IC and the driving circuit corresponding to the resolution of the display device which is obtained at that time. Consequently, the present invention can be applied to the driver IC and the driving circuit which be used in the display device having various resolutions, and the optional display size (resolution) in the display screen mode can be changed easily.

According to the EMBODIMENT 2, in the function of selecting the display screen mode to be displayed with an optional display size (resolution), the valid data period of the data enable input signal corresponding to the display screen mode selected at that time is controlled, and the valid data period of the data enable input signal is counted with each clock every horizontal cycle and every vertical cycle, the counted value is held and the value held at the last time is utilized for the next horizontal cycle or the next vertical cycle, thereby generating a signal to be input to the driver IC and the driving circuit corresponding to the resolution of the display device which is obtained at that time. Consequently, it is possible to obtain the effect that the optional display size (resolution) in the display screen mode can be changed easily.

According to the EMBODIMENT 2, in the function of selecting the display screen mode for display with an optional display size (resolution), the valid data period of the data enable input signal corresponding to the display screen mode selected at that time is controlled and the value of the resolution which is obtained at that time is simultaneously recognized in response to the selecting input signal 24, thereby generating the input signal in the driver IC and the driving circuit corresponding to the resolution of the display device which is obtained at that time. Consequently, it is possible to obtain the effect that an optional display size (resolution) in the display screen mode can be changed easily.

EMBODIMENT 3

Figure 4:
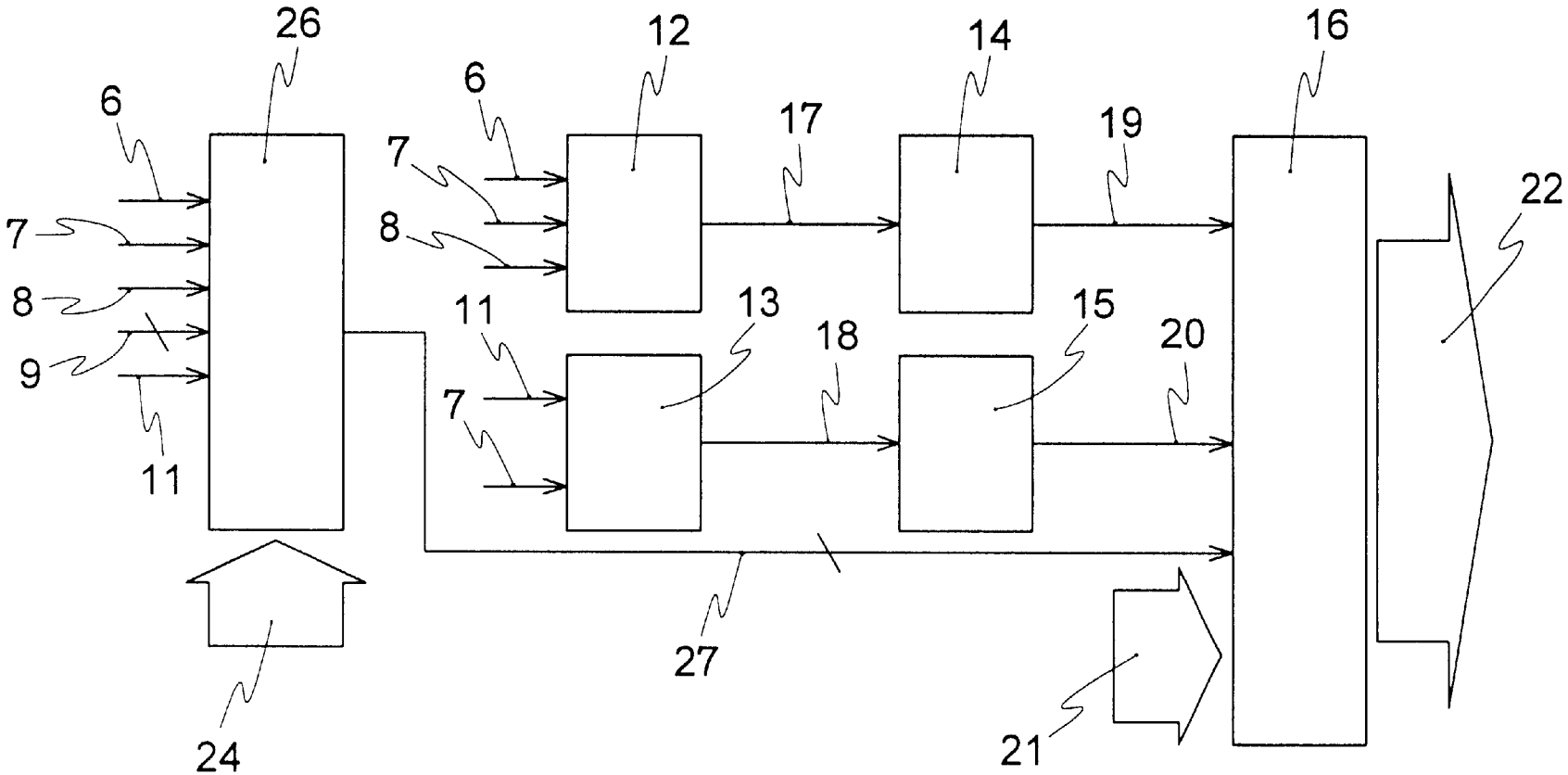
FIG. 4 is a functional block diagram 1 for showing a structure of the circuit of a control circuit or a part of the control circuit in a display device of embodiment 3 of the present invention.

FIG. 4 is a diagram showing, for each functional block, the structure of a control circuit provided in a display device or a part of the control circuit according to an EMBODIMENT 3 of the present invention. In FIG. 4, the reference numeral 12 denotes a horizontal clock counter for counting a clock number for a valid data period every horizontal cycle, that is, a circuit section for counting a resolution in a horizontal direction, reference numeral 13 denotes a vertical clock counter for counting a clock number for a valid data period every vertical cycle, that is, a circuit section for counting a resolution in a vertical direction, reference numeral 14 denotes a horizontal clock count memory for holding a horizontal clock count value counted in a last-stage for a predetermined period or all the time, the reference numeral 15 denotes a vertical clock count memory for holding a vertical clock count value counted in a last stage for a predetermined period or all the time, reference numeral 16 denotes an input signal generating section in a driver IC and a driving circuit, reference numeral 26 denotes a section for selecting a valid data period in a display data input signal, reference numeral 17 denotes a horizontal clock count signal, the reference numeral 18 denotes a vertical clock count signal, reference numeral 19 denotes a signal 1 indicative of a counter value holding the horizontal clock count signal 17 for a predetermined period or all the time, reference numeral 20 denotes a signal indicative of a counter value holding the vertical clock count signal 18 for a predetermined period or all the time, reference numeral 21 denotes a plurality of signals to be input from the outside, reference numeral 22 denotes a plurality of signals to be output to the outside, reference numeral 24 denotes a selecting input signal in a display screen mode for display with an optional display size (resolution), and reference numeral 27 denotes a video data input signal having a valid data period in the selected resolution. In some cases, the input signal generating section 16 includes a conventional control circuit or a part of the control circuit.

In the valid data period selecting section 26, first of all, a display screen mode for display with an optional display size (resolution) is uniquely selected in response to the selecting input signal 24 sent from the outside, and the video data input signal 27 having the valid data period corresponding to the resolution is generated and output. The structure of the circuit connected following the valid data period selecting section 26 and the contents of operation are the same as those in FIG. 1. The video data input signal 9 included in the input signal 21 sent from the outside which is to be input to the input signal generating section 16 in FIG. 1 is input as the video data input signal 27 in FIG. 4. Moreover, the video data input signal 27 generated in the valid data period selecting section 26 can also be subjected to the masking treatment of an invalid data signal in a portion to be an invalid data period for the video data input signal 9 and can increase or reduce the resolution.

In the EMBODIMENT 3, also in the case where the resolution of the display screen mode is not coincident with that of the display device, they can become coincident with each other. At this time, the data enable signal 7 may be changed in response to the screen mode selecting input signal 24, thereby generating a new data enable signal 25 in the same manner as in the EMBODIMENT 2.

Consequently, when the display screen mode for display with optional display size (resolution) is selected in response to the selecting input signal 24 in FIG. 4, the video data input signal 27 having the valid data period corresponding to the display screen mode selected at that time is generated and the valid data period of the data enable input signal is counted with each clock every horizontal cycle and every vertical cycle, and the value (count value) of the resolution is automatically recognized to generate the input signal in the driver IC and the driving circuit corresponding to the resolution of the display device which is obtained at that time. Consequently, the present invention can be applied to the driver IC and the driving circuit which can be used in the display device having various resolutions, and the optional display size (resolution) in the display screen mode can be changed easily.

Figure 5:
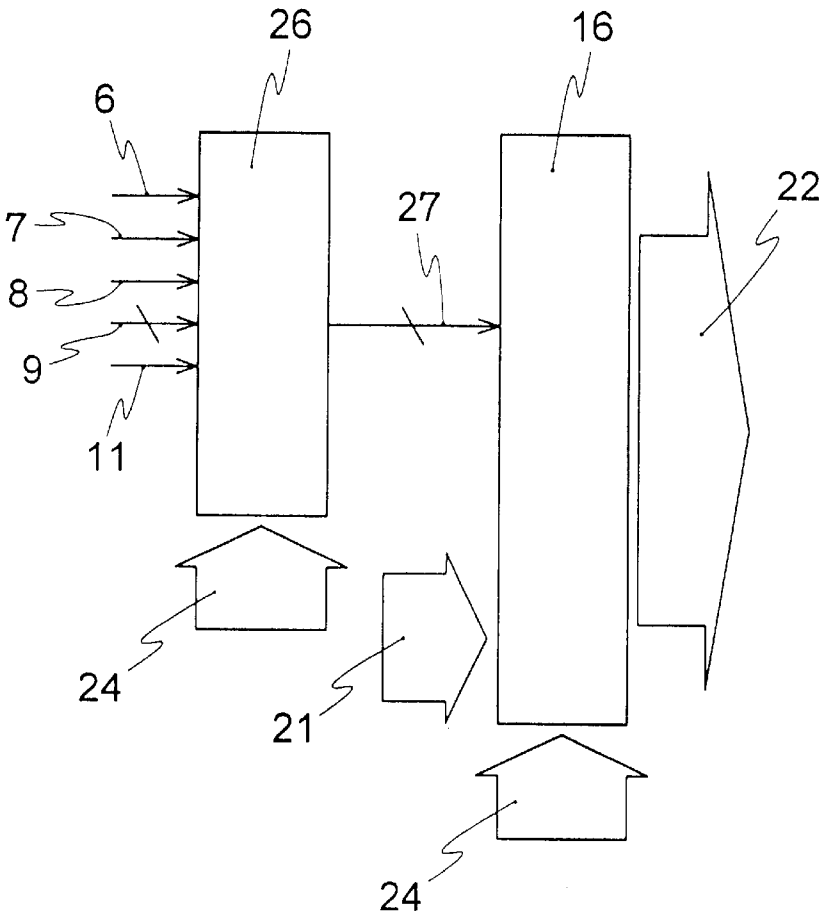
FIG. 5 is a functional block diagram 2 for showing a structure of the circuit of a control circuit or a part of the control circuit in a display device of embodiment 2 of the present invention.
Figure 6:
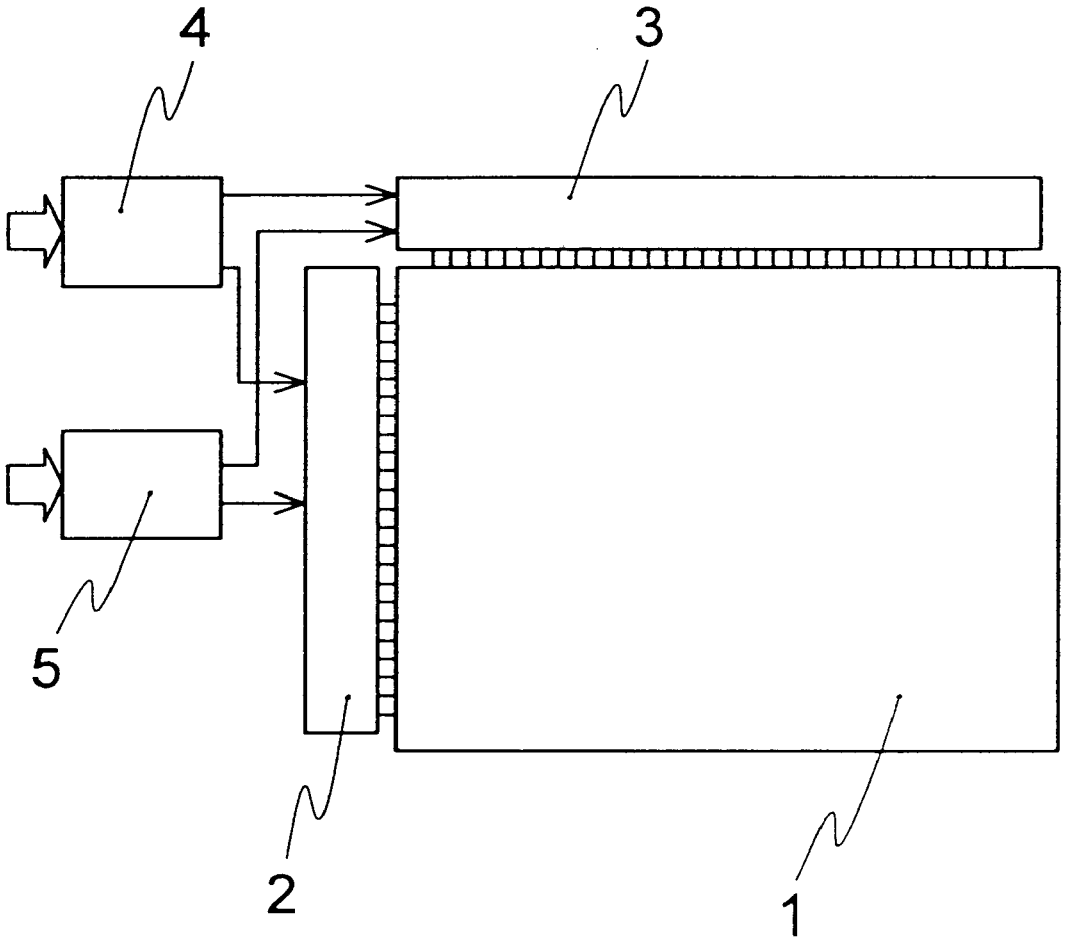
FIG. 6 is an explanatory view showing a whole of the conventional display device.

FIG. 5 is a diagram showing, for each functional block, the structure of a control circuit provided in a display device or a part of the control circuit according to another example of the EMBODIMENT 3 of the present invention. In FIG. 5, reference numeral 16 denotes an input signal generating section in a driver IC and a driving circuit, reference numeral 26 denotes a section for selecting a valid data period in a video data input signal, reference numeral 21 denotes a plurality of signals to be input from the outside, reference numeral 22 denotes a plurality of signals to be output to the outside, reference numeral 24 denotes a selecting input signal in a display screen mode to be displayed with an optional display size (resolution), and reference numeral 27 denotes a video data input signal having a valid data period in the selected resolution. In some cases, the input signal generating section 16 includes a conventional control circuit or a part of the control circuit.

Thus, when the display screen mode for display with an optional display size (resolution) is selected in response to the selecting input signal 24 in FIG. 5, the video data input signal 27 having the valid data period corresponding to the display screen mode selected at that time is generated and the input signal generating section 16 simultaneously recognizes, in response to the selecting input signal 24, the value of the resolution which is obtained at that time, thereby generating the input signal in the driver IC and the driving circuit corresponding to the resolution of the display device which is obtained at that time. Consequently, the present invention can be applied to the driver IC and the driving circuit which can be used in the display device having various resolutions, and the optional display size (resolution) in the display screen mode can be changed easily.

According to the EMBODIMENT 3, in the function of selecting the display screen mode for display with an optional display size (resolution), the valid data period of the video data input signal corresponding to the display screen mode selected at that time is controlled, thereby generating an input signal in the driver IC and the driving circuit corresponding to the resolution of the display device which is obtained at that time. Consequently, it is possible to obtain the effect that an optional display size (resolution) in the display screen mode can be changed easily.

According to the first and second aspects of the present invention, the valid data period of the data enable input signal is counted with each clock every horizontal cycle and every vertical cycle, the counted value is held and the value held at the last time is utilized for the next horizontal cycle or the next vertical cycle, thereby generating signal to be input to the driver IC and the driving circuit corresponding to the resolution of the display device which is obtained at that time. Consequently, the present invention can be applied to the driver IC and the driving circuit which can be used in the display device having various resolutions. Thus, it is possible to obtain an effect that a period for development can be shortened and a cost of an development can be reduced.

According to the third and fourth aspects of the present invention, in the function of selecting the display screen mode for display with an optional display size (resolution), the valid data period of the data enable input signal corresponding to the display screen mode selected at that time is controlled, and the valid data period of the data enable input signal is counted with each clock every horizontal cycle and every vertical cycle, the counted value is held and the value held at the last time is utilized for the next horizontal cycle or the next vertical cycle, thereby generating a signal to be input to the driver IC and the driving circuit corresponding to the resolution of the display device which is obtained at that time. Consequently, it is possible to obtain an effect that the optional display size (resolution) in the display screen mode can be changed easily.

According to the fifth and sixth aspects of the present invention, in the function of selecting the display screen mode for display with an optional display size (resolution), the valid data period of the data enable input signal corresponding to the display screen mode selected at that time is controlled and the value of the resolution which is obtained at that time is simultaneously recognized in response to the selecting input signal, thereby generating the input signal in the driver IC and the driving circuit corresponding to the resolution of the display device which is obtained at that time. Consequently, it is possible to obtain the effect that the optional display size (resolution) in the display screen mode can be changed easily.

According to the seventh and eighth aspects of the present invention, in the function of selecting the display screen mode for display with an optional display size (resolution), the valid data period of the video data input signal corresponding to the display screen mode selected at that time is controlled, thereby generating an input signal in the driver IC and the driving circuit corresponding to the resolution of the display device which is obtained at that time. Consequently, it is possible to obtain the effect that the optional display size (resolution) in the display screen mode can be changed easily.

Numerous modifications and alternative embodiments of the invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A display device, having a variable resolution, for use with a driver IC and a driving circuit, the display device comprising:

at least one of a horizontal clock counter and a vertical clock counter configured to count each clock signal, wherein the horizontal clock counter is configured to count a horizontal valid data period of a data enable input signal for each horizontal cycle, and the vertical clock counter is configured to count a vertical valid data period of a data enable input signal for each vertical cycle; and an input signal generating section configured to hold the horizontal valid data period count or the vertical valid data period count, corresponding to a display screen mode and to generate an input signal for the driver IC and the driving circuit based on the value of the horizontal valid data period count or the vertical valid data period count, wherein the horizontal valid data period count represents a horizontal variable resolution value and the vertical valid data period count represents a vertical variable resolution value.

2. The display device according to claim 1, further comprising:

a valid data period selecting section configured to control a valid data period of a data enable input signal corresponding to a display screen mode selected in response to a selecting input signal in a display screen mode for display with a variable display size; and an input signal generating section configured to count each clock signal every horizontal cycle or every vertical cycle for the valid data period of the data enable input signal, to hold a count value, and to generate an input signal for a driver IC and a driving circuit.

3. The display device according to claim 1, wherein the display device includes an LCD device.

4. An interface circuit for use with a display device having a variable resolution, comprising:

at least one of a horizontal clock counter and a vertical clock counter configured to count each clock signal, wherein the horizontal clock counter is configured to count a horizontal valid data period of a data enable input signal for each horizontal cycle, and the vertical clock counter is configured to count a vertical valid data period of a data enable input signal for each vertical cycle; and an input signal generating section configured to hold the horizontal valid data period count or the vertical valid data period count, corresponding to a display screen mode and to generate an input signal for the driver IC and the driving circuit based on the value of the horizontal valid data period count or the vertical valid data period count, wherein the horizontal valid data period count represents a horizontal variable resolution value and the vertical valid data period count represents a vertical variable resolution value.

5. The interface circuit according to claim 4, further comprising:

a data valid period selecting section configured to control a valid data period of a data enable input signal corresponding to a display screen mode selected in response to a selecting input signal in a display screen mode for display with a variable display size; and an input signal generating section configured to count each clock signal every horizontal cycle or every vertical cycle for the valid data period of the data enable input signal, to hold a count value, and to generate an input signal for a driver IC and a driving circuit.

* * * * *